US005348408A

United States Patent [19]

Gelardi et al.

[11] Patent Number: 5,348,408

[45] Date of Patent: Sep. 20, 1994

[54] WRIST PAD FOR USE WITH KEYBOARDS

[76] Inventors: John A. Gelardi, P.O. Box 714, Kennebunkport, Me. 04046; Anthony Gelardi, P.O. Box 213, Cape Porpoise, Me. 04014; Leonard Goldman, P.O. Box 1491, Kennebunkport, Me. 04046

[21] Appl. No.: 940,840

[22] Filed: Sep. 4, 1992

[51] Int. Cl.[5] ..... B41J 29/00

[52] U.S. Cl. ..... 400/715; 400/719

[58] Field of Search ..... 400/715, 719; 248/118, 248/118.1, 118.3, 118.5, 918

[56] References Cited

U.S. PATENT DOCUMENTS

| | | | |
|---|---|---|---|
| 4,329,981 | 5/1982 | Dungl | 128/25 |
| 4,973,176 | 11/1990 | Dietrich | 400/715 |
| 5,050,826 | 9/1991 | Johnston | 400/715 |
| 5,104,073 | 4/1992 | VanBeek et al. | 248/918 |
| 5,158,256 | 10/1992 | Gross | 248/118.3 |
| 5,183,230 | 2/1993 | Walker et al. | 248/118 |

FOREIGN PATENT DOCUMENTS

| | | | |
|---|---|---|---|
| 0285997 | of 1931 | Italy | 248/118.1 |

*Primary Examiner*—Edgar S. Burr
*Assistant Examiner*—Anthony H. Nguyen
*Attorney, Agent, or Firm*—James Creighton Wray

[57] ABSTRACT

A wrist and arm pad for use with keyboards is disclosed. The pad has a support means which is adjustable perpendicularly with respect to the keyboard for accommodating varying anatomies and preferences. The pad is also movable horizontally with respect to the keyboard, allowing the user to access all of the keyboard without removing wrists from the support. A preferred pad has a base with rollers and anti-skid pads, a movable support means lying on the base, and a flexible overlay peripherally attached to the base and enveloping the support means. Handles attached to the support means extend out of apertures in the envelope for adjustment. A frame is provided for holding the overlay to the base, and massage dots can be provided on the upper surface of the overlay. A platform plate and clamp are provided for extension of the work surface for attaching or placing of the wrist pad assembly.

19 Claims, 4 Drawing Sheets

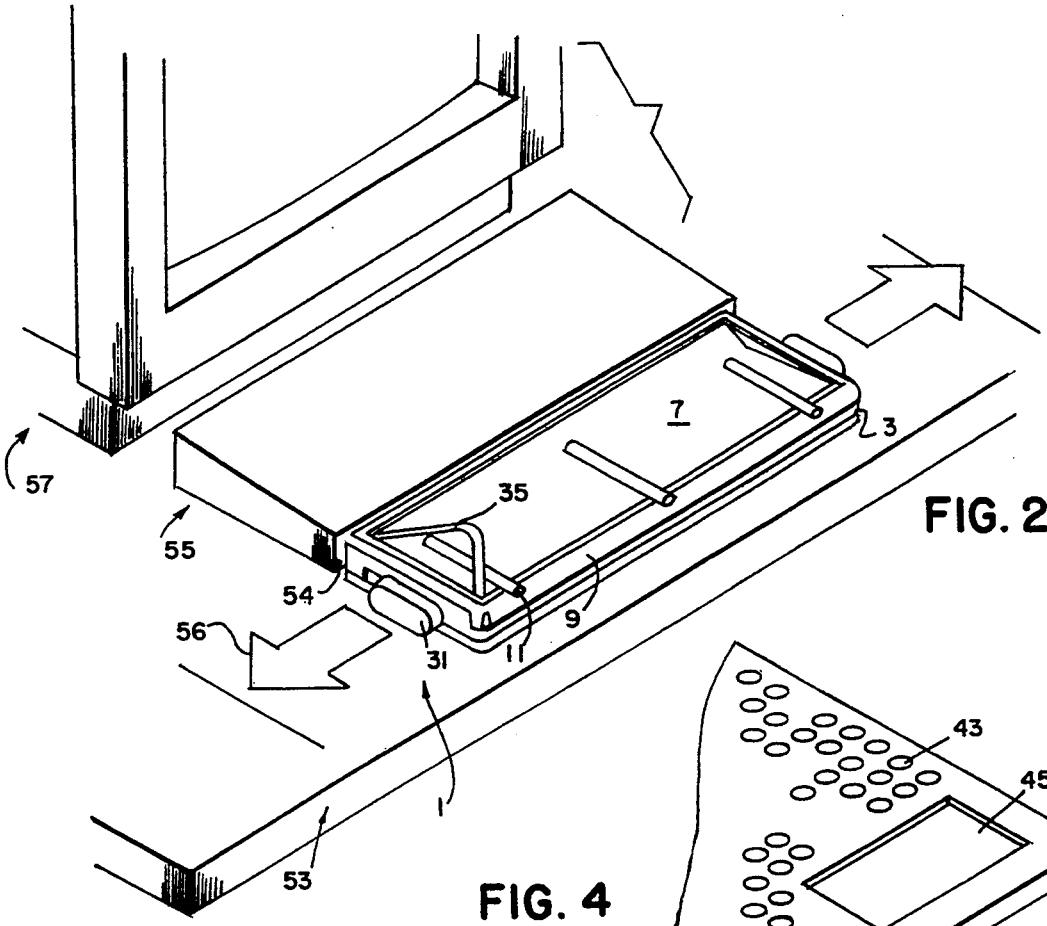
FIG. 2
FIG. 4
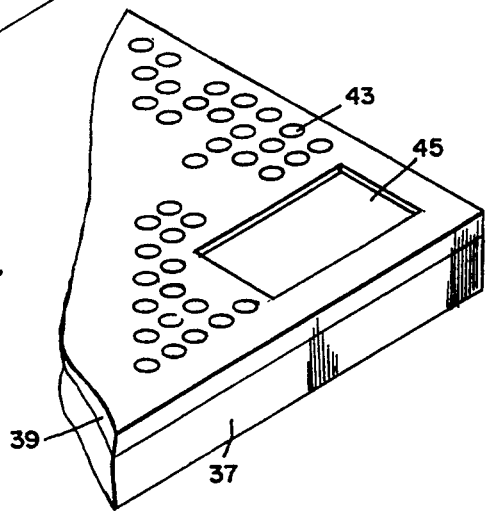
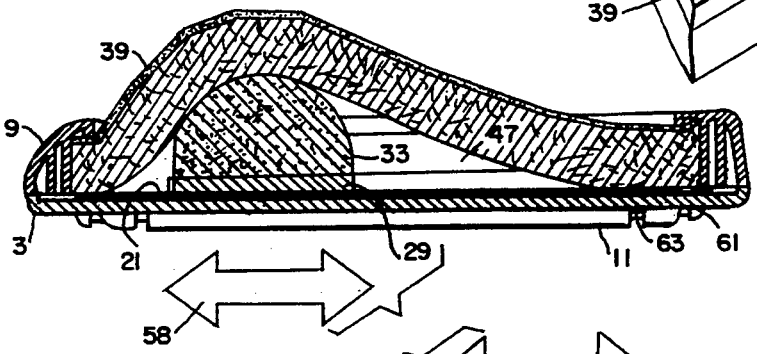
FIG. 3
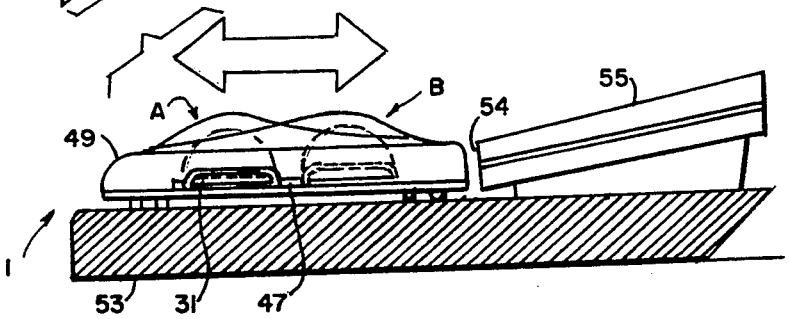
FIG. 6

WRIST PAD FOR USE WITH KEYBOARDS

BACKGROUND OF THE INVENTION

The present invention relates to wrist or arm pads for use with keyboards.

Users of keyboards typically rest their wrists and forearms on the table surface or the edge of the table in front of the keyboard when using the keyboard. The movement between the "at rest" position on the table and a typing position with the hands actually suspended above the keyboard can be repeated hundreds of times daily. The resulting stress caused by the repeated motion, as well as the hardness of the table and table edge, can result in injuries. The use of foam pads and other support and cushioning devices for cushioning the user's wrists with respect to the table and elevating the hands is known in the art.

These pads are typically standardized for all operators and do not allow for varying forearm and wrist lengths and thicknesses. Also, frequent users may wish to vary the height or placement of the support pad with respect to the keyboard to rest certain sets of muscles. A need exists for a wrist and forearm support pad which is adjustable to fit varying sizes of anatomies, as well as to varying preferences of hand placement.

SUMMARY OF THE INVENTION

The present invention provides a wrist and forearm pad for use with a keyboard which allows for side to side movements of the hands resting on the support in front of the keyboard, and which provides a means for changing the point of support on the forearm and wrist to accommodate varying anatomies, preferences and needs of users.

In a preferred embodiment, the invention has a flattened, elongated base which is approximately as long as a standard keyboard, a movable elongated support means extending upwards from and mounted on the base for positioning roughly parallel to the front of a keyboard, and a flexible overlay enveloping the support means through a peripheral attachment to the base. The base preferably incorporates rollers which allow for side to side movements with respect to the keyboard.

In a preferred embodiment, a platform can be provided under the base for attachment to a desk or table. Attachment means allow for securing to the table, while an upper surface is preferably large enough to allow for movement of the base. The platform can also be large enough to accommodate a keyboard.

Anti-skid pads can be provided on the base to prevent skidding of the pad apparatus during use. The rollers can be mounted on springs or shock absorbers that cause the rollers to protrude below the anti-skid pads when the user lifts some of the weight of the forearms off of the pad apparatus to thereby allow side to side movement before reapplying weight to compress the springs and contact the anti-skid pads on the table surface.

A preferred base is rectangular, with the support bar being of a lesser width. End apertures are provided between the side ends of the envelope between the attachment of the overlay with the base. First and second opposite handles attached to the support bar and extending out of the slots or apertures allow for perpendicular movement of the support bar within the envelope with respect to the front of the keyboard. The support bar preferably has a rigid bottom to which the handles are attached and which slides along a top face of the base, and a cushioning member extending upwards from the rigid bottom. The cushioning member preferably extends substantially along the length of the bar and envelope to provide full coverage of the keyboard. The cushioning member provides a soft fulcrum upon which the user's wrists and forearms rest. Moving the support member within the envelope changes the point of contact between the user's arm and the support member, and allows for keeping of an "optimal" fulcrum point for all users, regardless of anatomy.

The overlay is preferably a flexible sheet-like member. Preferred constructions are foam, cushioned cloth or similar materials. In one embodiment, a lower layer is made of low density foam and an upper layer is made of high density foam to provide optimal cushioning, yet allow for increased resistance to wear and tear on its upper surface. A lubricating layer, such as a plastic sheet or polypropylene laminate, can be provided on the inside of the overlay to reduce friction with the compressible support member. The compressible support member is typically made of a foam material which is resilient.

A peripheral frame member can be provided for attaching and reinforcing the peripheral attachment of the overlay to the base. Side end slots or tracks can be provided adjacent the handle apertures in the envelope to allow for sliding of the handles therein. Locking and guiding mechanisms can be provided proximal the handles for facilitating smooth movement of the support bar and locking of the support bar into one position.

In one preferred embodiment, raised, spaced massage pads are provided on the upper face of the overlay for massaging the user's wrist when typing. Preferred massage pads are relatively small disk-shaped pads spaced in close position to one another.

A preferred wrist pad for use with keyboards has a base, a movable wrist support member which is movable with respect to the base and extends upwards therefrom, and a flexible overlay which is attached peripherally to the base with an attachment means to thereby at least partially envelop the movable support bar. Rollers are attached to the base for allowing for movement of the wrist pad, and the attachment means is a peripheral frame which attaches edges of the overlay to edges of the base. The support member has an upraised cushioning means extending towards the overlay. The cushioning means is preferably a resilient foam support.

At least one handle can be provided on the wrist support extending out of the envelope for allowing the user to move the support member within the envelope. Anti-skid pads can be provided on a bottom of the base. In one embodiment, springs are provided between the roller and the base provided in conjunction with the anti-skid pads. The weight of a user's wrist on the wrist pad compresses the springs so that the anti-skid pads extend below the rollers and prevent movement of the wrist pad. The rollers extend below the anti-skid pads when the springs are extended.

The overlay has at least one layer of flexible material. In a preferred embodiment, the overlay has an inner layer of low density foam material and an outer layer of high density foam material. A preferred embodiment incorporates spaced, raised massage members extending upward from the overlay to massage the user's wrist resting on the wrist pad. The raised massage members can be relatively small, flattened massage disks.

The wrist pad assembly can incorporate a base plate which is attached to a table or desk so that it extends outward. This extends the area on a work surface for placement of the pad. The wrist pad can then be attached to the plate or placed on top so that it can move on the surface of the plate.

In a preferred embodiment, the base is generally an elongated, flattened plate having one side approximating the length of a keyboard. The plate has a relatively flat upper surface. The support member is a flattened, elongated bar which is slidable on the surface of the base transversely across the base with respect to the elongated side to be placed adjacent a keyboard. The bar further incorporates handles which protrude out of the envelope for facilitating movement of the bar by the user, and has a cushioning member extending upwards away from the base plate along a substantial length of the bar. The bar and cushioning member have widths less than that of the width of the base plate for changing the point of incidence between the user's wrist and the support member with respect to the keyboard. The overlay is a flexible member peripherally attached to the base plate and allowing for movement of the support member within the envelope prescribed thereby.

These and further and other objects and features of the invention are apparent in the disclosure, which includes the above and ongoing written specification, with the claims and the drawings.

BRIEF DESCRIPTION OF THE DRAWINGS

FIG. 2 is an elevational view of the wrist pad showing the side to side movement of the wrist pad as facilitated by the rollers.

FIG. 3 is a cross-sectional view of the wrist pad showing the envelope of the overlay and base encasing the movable support means.

FIG. 4 is an exploded view of the massage pads provided on the exterior of the overlay.

FIG. 6 is a side view further illustrating this perpendicular movement of the support means within the envelope.

DETAILED DESCRIPTION OF THE DRAWINGS

Figure 1:
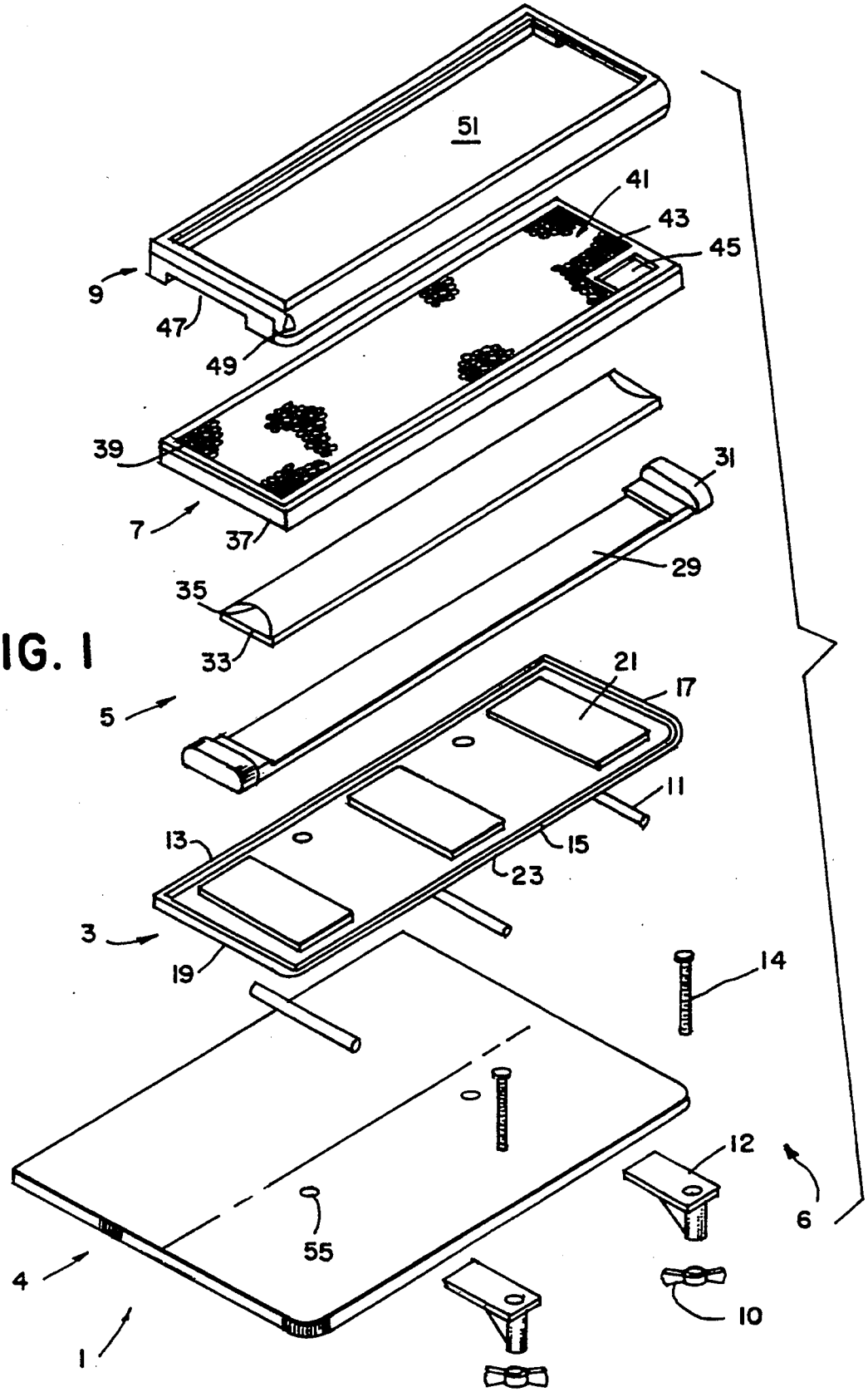
FIG. 1 is an elevational assembly view of a preferred adjustable wrist pad.

The wrist or forearm pad for use with keyboards is generally indicated by the numeral 1 in FIG. 1 shown in a disassembled state. The basic components of the pad 1 are a base 3, a movable wrist support means 5, an overlay 7, a frame 9, and rollers 11.

In a preferred embodiment, the base 3 is a rectangular plate-like structure having first and second long sides 13 and 15, and first and second short sides 17 and 19. One of the long sides 13 and 15 may preferably be approximately the length of the front of a keyboard, but shorter, more compact pads are in accordance with the present invention. The base has a generally flat planar upper surface 21 and a lower surface 23. The lower surface 23 preferably incorporates attachment means (not shown) for attaching to rollers 11. The base may be a molded article with receptacles for tubular, cylindrical, ball-bearing or other type rollers, or separate attachment means may be provided. In a preferred embodiment, the attachment means incorporates springs or shock absorbers for allowing the rollers to engage or disengage, depending on the weight applied to the pad. The base 3 is preferably attached peripherally to the overlay 7 through the use of suitable means, such as a frame member 9 which engages the periphery of the overlay 7.

In a preferred embodiment shown in FIG. 1, the wrist support means 5 incorporates an elongated bar 29 which rests on the flat planar surface 21 and is movable perpendicularly with respect to the front of a keyboard. Attached or molded on opposite ends of the bar 29 are handles 31, which extend beyond the first and second short sides 17 and 19 and out of the envelope for facilitating movement of the support member on the base. A compressible upper support member 33 is mounted on the bar and extends upwards to provide a support or rest for the user's wrists. The upper support member 33 is preferably made of a resilient foam material and has a curved upper surface 35, which facilitates movement between the surface and the overlay and provides a comfortable surface.

The overlay 7 can be any suitable flexible member. A preferred overlay is made of foam. In FIG. 1, an inner, low density foam layer 37 is attached to an outer, high density foam layer 39, with both being peripherally attached to the base. Raised massage pads 43, such as disk-shaped massage pads, can be provided on the outer surface of the flexible member to massage the user's arms when in use. A logo area 45 can also be provided on the outer surface of the overlay.

The wrist pad 1 is usable without the frame 9. However, the frame strengthens the attachment between the overlay and the base, hinders fraying of the edges of the overlay, adds to the attractiveness of the pad, and can provide a tracking and locking means 47 for the movable support means 5. A preferred frame 9 incorporates rounded corners and edges 49, and a central window through which the support means under the overlay extends. Tracks 47 are provided in conjunction with the handles 31 for facilitating movement therebetween. A locking member (not shown) can be provided on the frame, base or handle to facilitate locking of the handle and support member in a certain position.

In a preferred embodiment of the invention, a base plate 4 is provided for attachment with a table or desk to extend he work area for placement of the wrist pad and/or keyboard. The extension base plate 4 incorporates table attachment means 6, which in a preferred embodiment are brackets 12, bolts 14 threaded through apertures 55 in the base plate, and wing nuts 10.

Figure 7:
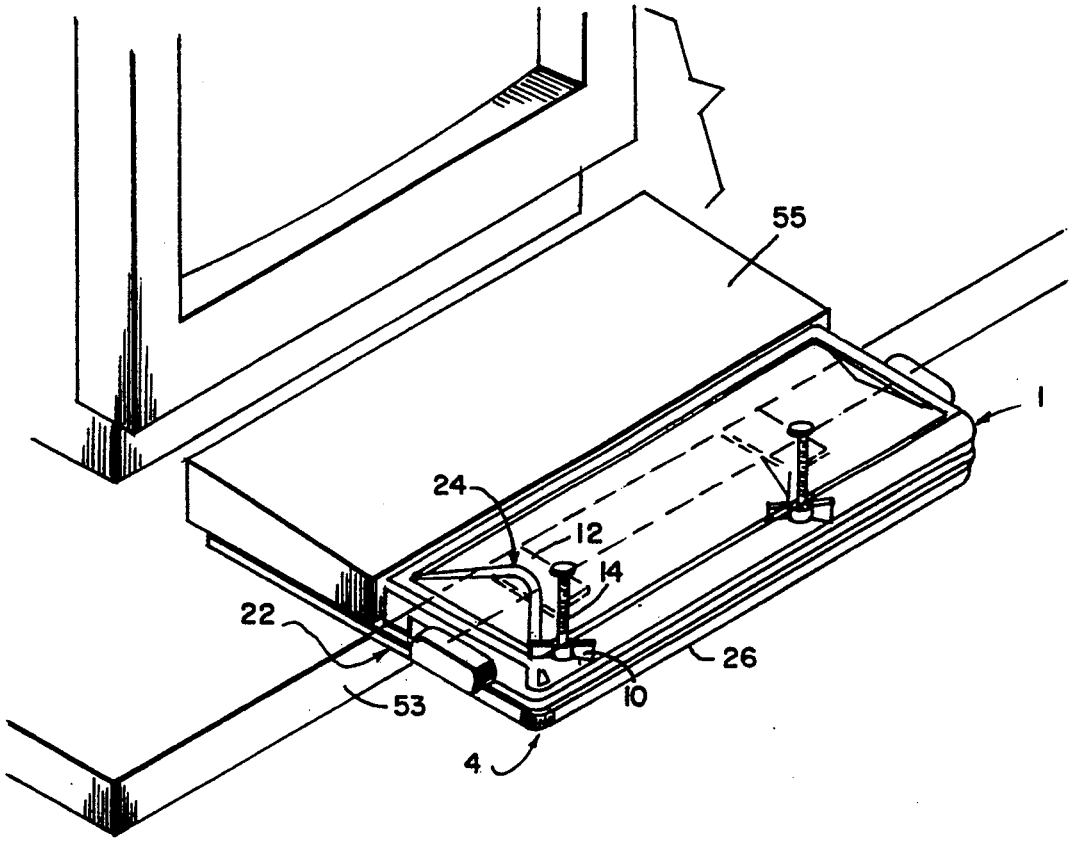
FIG. 7 is a plate and wrist pad assembly attached to the edge of the desk.

In FIG. 7, the edge 53 of a table is grasped between the bottom 22 of the plate and the tops 24 of the brackets, with the user tightening the wing nuts 10 on the bolts 14 to firmly grip the table and provide an outward extension 26 with the plate 4 therefrom. The wrist pad 1 is placed on the plate or is movably attached thereto. Preferably the plate is large enough to provide sufficient room for side-to-side movements of the pad, and in a preferred embodiment, for adjacent placement of the keyboard 55.

As shown in FIG. 2, the pad 1 rests upon a flat substrate such as a table 53, with the computer 57 positioned in front of it. A keyboard 55 has a front face 54 which lies adjacent one of the longer sides 13 of the present invention. The rollers 11 allow for side to side movements with respect to the front face 54, as indicated by arrows 56. This allows the user, with wrists resting on the support under the overlay 7, to reach the entire keyboard without repeatedly lifting his hands off the keyboard.

As shown by the cross-sectional view of the pad 1 in FIG. 3, the base 3 is attached to rollers 11 through a roller connection means 63. The roller connection means may be used on conjunction with springs or shock absorbers to allow vertical movement of the rollers with respect to anti-skid pads 61. Under the weight of the pad, the springs are extended and the rollers 11 are below the anti-skid pads 61 so that the pad is movable. However, with the user's arms resting on the support member, the springs are compressed and the anti-skid pads rest on the table.

The support member bar 29 preferably lies on the flat surface 21, with the handles extending out of the tracking aperture 47. The user grasps the handles and moves the support member under the overlay perpendicularly with respect to the front face 54 of the keyboard 55, as indicated by arrows 58. The frame 9 preferably grabs and holds the periphery of the overlay to the base, securing and hiding the edges of the overlay.

In FIG. 4, the massage pads 43 are preferably disk-shaped members with flattened tops provided in a spaced relationship for massaging a user's wrists. The massage disks can be provided with a flexible molded sheet 59 which is attached to the surface of the overlay, or can be provided on the overlay itself.

Figure 5:
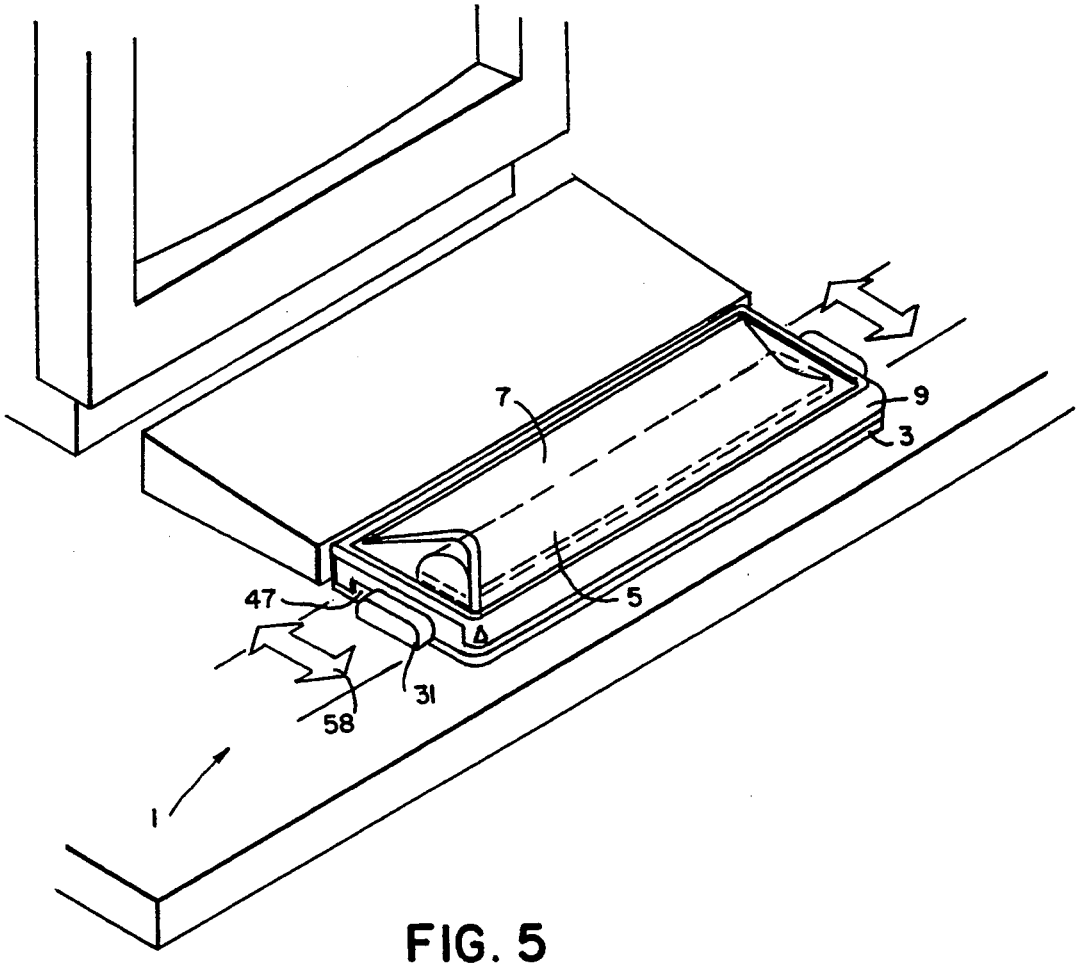
FIG. 5 is an elevational perspective showing the movement of the inner support means via the handles perpendicular to the front of the keyboard.

In FIG. 5, the perpendicular movement 58 with respect to the front face 54 allows for changing of the support point, or the top of the support means, with respect to the keys on the keyboard. This accommodates the varying anatomies of those using the pad, as well as preferences or needs of the user.

In FIG. 6, the perpendicular movement 58 prescribes first and second extreme positions A and B, as facilitated by movement of the handles 31 within the tracking means 47. Position A provides support several inches further away from the keyboard than does Position B.

While the invention has been described with reference to specific embodiments, modifications and variations of the invention may be constructed without departing from the scope of the invention, which is defined in the following claims.

I claim:

1. A wrist pad for use with keyboards comprising a base, a movable wrist support member which is movable with respect to the base and extends upwards therefrom, a flexible overlay, an attachment means for attaching the flexible overlay peripherally to the base to at least partially envelop the movable support member, the support member being mounted for movement with respect to the overlay.

2. The apparatus of claim 1, further comprising rollers attached to the base for allowing for movement of the wrist pad.

3. The apparatus of claim 1, further comprising the attachment means being a peripheral frame which attaches edges of the overlay to edges of the base.

4. The apparatus of claim 1, further comprising the support member having an upraised cushioning means extending towards the overlay.

5. The apparatus of claim 4, wherein the cushioning means is a resilient foam support.

6. The apparatus of claim 4, further comprising at least one handle provided with the wrist support and extending out of the envelope for allowing the user to move the support member within the envelope.

7. The apparatus of claim 1, further comprising at least one anti-skid pad provided on a bottom of the base.

8. The apparatus of claim 1, further comprising the overlay having at least one layer of flexible foam material.

9. The apparatus of claim 8, further comprising the overlay having an inner layer and an outer layer, the inner layer being of foam material having a lower density than that of the outer layer of foam material.

10. The apparatus of claim 1, further comprising spaced, raised massage members extending upward from the overlay to massage the user's wrist resting on the wrist pad.

11. The apparatus of claim 11, further comprising the raised massage members being relatively small, flattened massage disks.

12. The apparatus of claim 1, further comprising the base being a generally elongated, flattened plate, the support member being a flattened, elongated bar which is slidable on the surface of the base perpendicular with respect to the keyboard, the bar further incorporating handles which protrude out of the envelope for facilitating movement of the bar by the user and further incorporating a cushioning member extending upwards away from the base plate along a substantial length of the bar, wherein the bar and cushioning member have widths less than that of the width of the base plate for changing the point of incidence between the user's wrist and the support member with respect to the keyboard; the overlay further being a flexible member peripherally attached to the base plate and allowing for movement of the support member within the envelope prescribed thereby.

13. The apparatus of claim 1, further comprising an extension plate provided under the base for extending a work table, the plate being formed so as to allow for movement of the base and further having attachment means for attachment to the table's edge.

14. The apparatus of claim 14, further comprising the base being slidably attached to the plate.

15. A wrist pad for use with a keyboard comprising a base, a wrist support member carried by said base and extending upward therefrom, means mounting said wrist support member for movement relative to said base, a flexible overlay, and means to peripherally attach said flexible overlay to said base with said wrist support member at least partially enveloped between said base and said flexible overlay.

16. A hand support apparatus for use with a keyboard comprising an elongated base for mounting along a keyboard, a support mounted on the base for supporting hands of a user, and rollers mounted on the base for allowing side to side movements with respect to the keyboard without lifting the user's wrists from the support, the support comprising a flexible overlay, an attachment for attaching the flexible overlay peripherally to the base and the support being mounted on the base under the overlay for movement with respect to the overlay.

17. The apparatus of claim 16, wherein the rollers are mounted beneath the base.

18. The apparatus of claim 17, further comprising a non slip pad for positioning on a desk and wherein the rollers are mounted between the pad and the base.

19. The apparatus of claim 17, wherein the rollers are parallel and are transverse to an elongated direction of the base, and a lower surface of the base has attachment whereby the rollers are held in the base.

* * * * *